US008092047B2

(12) United States Patent
Ma et al.

(10) Patent No.: US 8,092,047 B2
(45) Date of Patent: Jan. 10, 2012

(54) LED LAMP

(75) Inventors: Xian-Wei Ma, Shenzhen (CN); Fu-Bo Gong, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 235 days.

(21) Appl. No.: 12/695,997

(22) Filed: Jan. 28, 2010

(65) Prior Publication Data

US 2010/0320932 A1 Dec. 23, 2010

(30) Foreign Application Priority Data

Jun. 18, 2009 (CN) ..... 2009 1 0303425

(51) Int. Cl.
*F21S 10/00* (2006.01)

(52) U.S. Cl. ..... 362/249.02; 362/249.03; 362/249.07

(58) Field of Classification Search . 362/249.02–249.11
See application file for complete search history.

(56) References Cited

U.S. PATENT DOCUMENTS 7,407,304 B2 * 8/2008 Tasson et al. ..... 362/249.07
7,665,864 B2 * 2/2010 Zheng et al. ..... 362/249.11
8,047,682 B2 * 11/2011 Zheng et al. ..... 362/249.05

* cited by examiner

*Primary Examiner* — Robert May
(74) *Attorney, Agent, or Firm* — Altis Law Group, Inc.

(57) ABSTRACT

An LED light lamp includes a lamp body, an adjusting rod, a number of light panels, and at least one rheostat. The lamp body defines a chamber therein. The adjusting rod includes a sliding bar, and an adjustable panel extending outwards from and surrounding an end of the sliding bar. The sliding bar is slidably received in the chamber of the lamp body. The adjustable panel includes an annular periphery. Each light panel includes a number of LED chips distributed on the light panel, and is pivotally mounted on the lamp body and against the annular periphery of the adjustable panel. A rheostat is electrically coupled into a power supply circuit of the LED chips. The resistance of the rheostat is adjusted to control the current flowing through the LED chips by the sliding bar when the sliding bar slides in the lamp body.

10 Claims, 6 Drawing Sheets

LED LAMP

BACKGROUND

1. Technical Field

The present disclosure relates to lamps, and in particular to a readily usable LED lamp.

2. Description of Related Art

Light-emitting diodes (LEDs) have characteristics that make them very attractive for applications such as lighting. A typical LED lamp consists of a cooling sheet with a number of LEDs. The LEDs are fixedly mounted on the cooling sheet and so cannot be adjusted to adjust illumination characteristics of the lamp.

What is needed is to provide an LED lamp, which can overcome the problems above.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Figure 1:
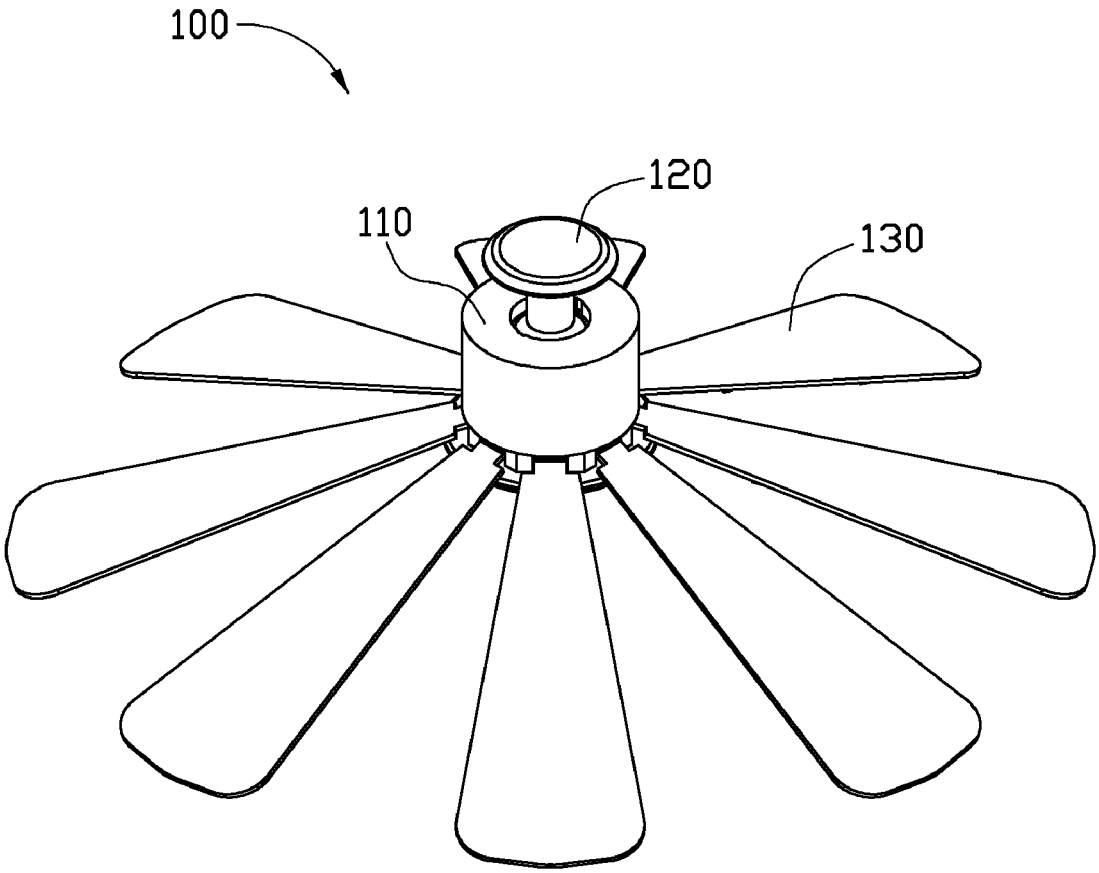
FIG. 1 is an isometric view of an LED lamp according to an exemplary embodiment.
Figure 2:
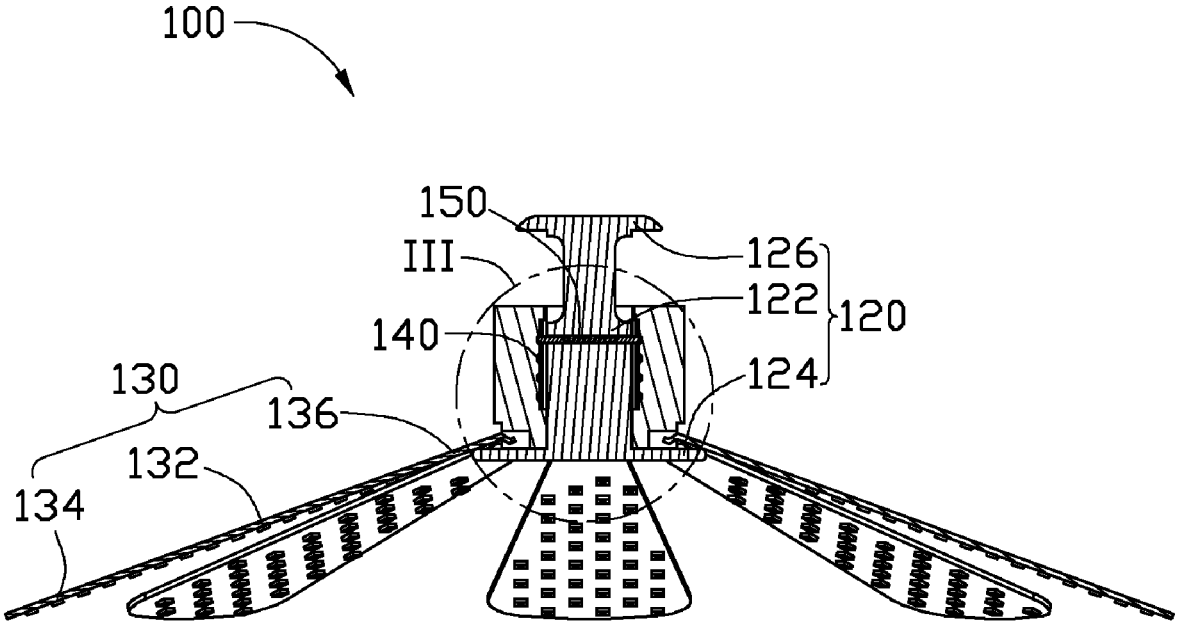
FIG. 2 is a cross section view of the LED lamp of FIG. 1
Figure 3:
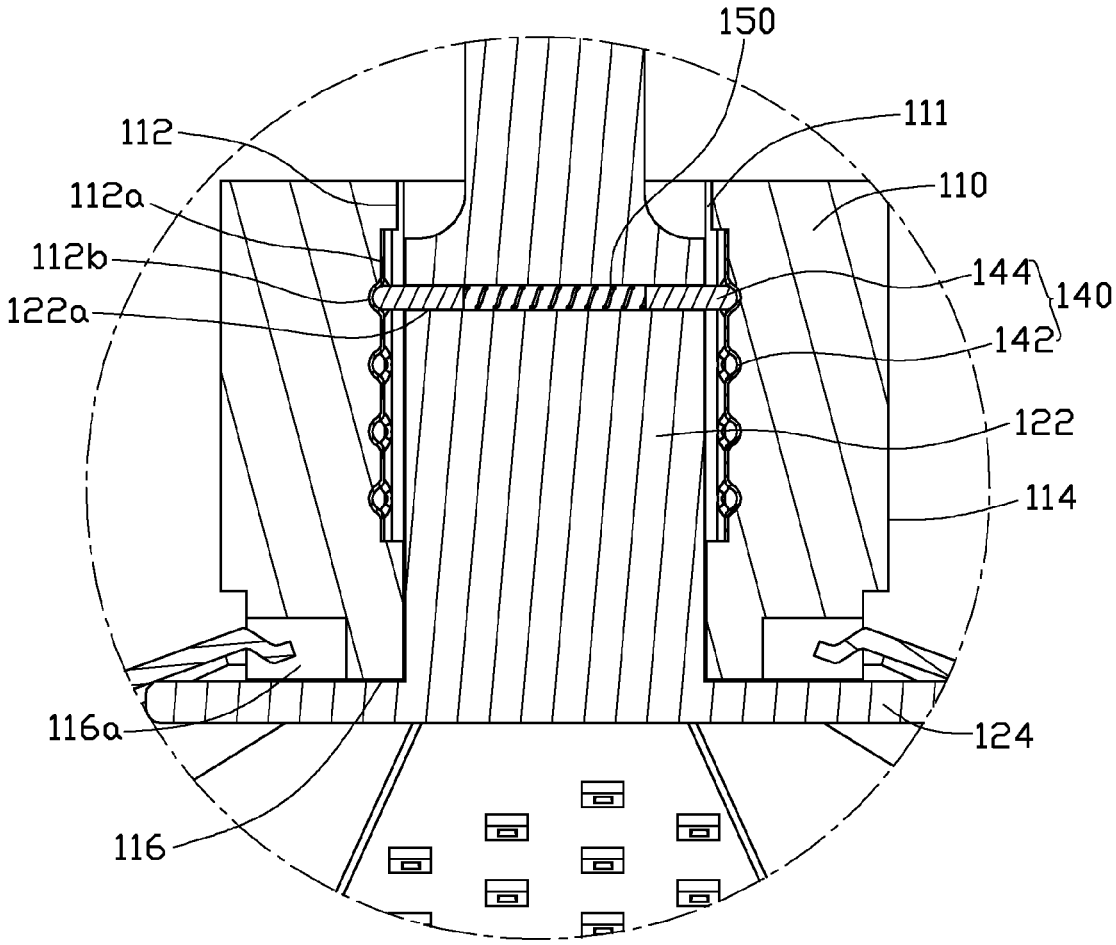
FIG. 3 is a partially cross-section view of the LED lamp of FIG. 2.

Referring to FIGS. 1 to 3, the LED lamp 100 includes a lamp body 110, an adjusting rod 120, and a number of light panels 130, at least one rheostat 140, and at least one flexible positioning member 150. The lamp body 110 is configured to be a hollow cylinder. The adjusting rod 120 includes a sliding bar 122, and an adjustable panel 124 extending outwards from and surrounding an end of the sliding bar 122. The adjustable panel 124 has an annular periphery. The sliding bar 122 is slidably received in the lamp body 110. Each of the light panels 130 includes a number of LED chips 132 evenly distributed thereon. The light panels 130 are pivotably mounted on the lamp body 110, and supported by the annular periphery of the adjustable panel 124. An angle defined between each light panel 130 and a center axis of the lamp body 110 is adjustable by moving the adjustable panel 124 along the center axis of the lamp body 110. The at least one rheostat 140 is electrically coupled to a power supply circuit of the LED chips 132. The resistance of the rheostat 140 coupled to the power supply circuit is adjustable to adjust the current flowing through the LED chips 132. The resistance of the rheostat 140 is adjusted by sliding the sliding bar 122 relative to the lamp body 110. The flexible positioning member 150 passes through the sliding bar 122 and resiliently resists against the inner surface of the lamp body 110 by the two opposite ends to maintain the position of the sliding bar 122 relative to the lamp body 110.

Figure 4:
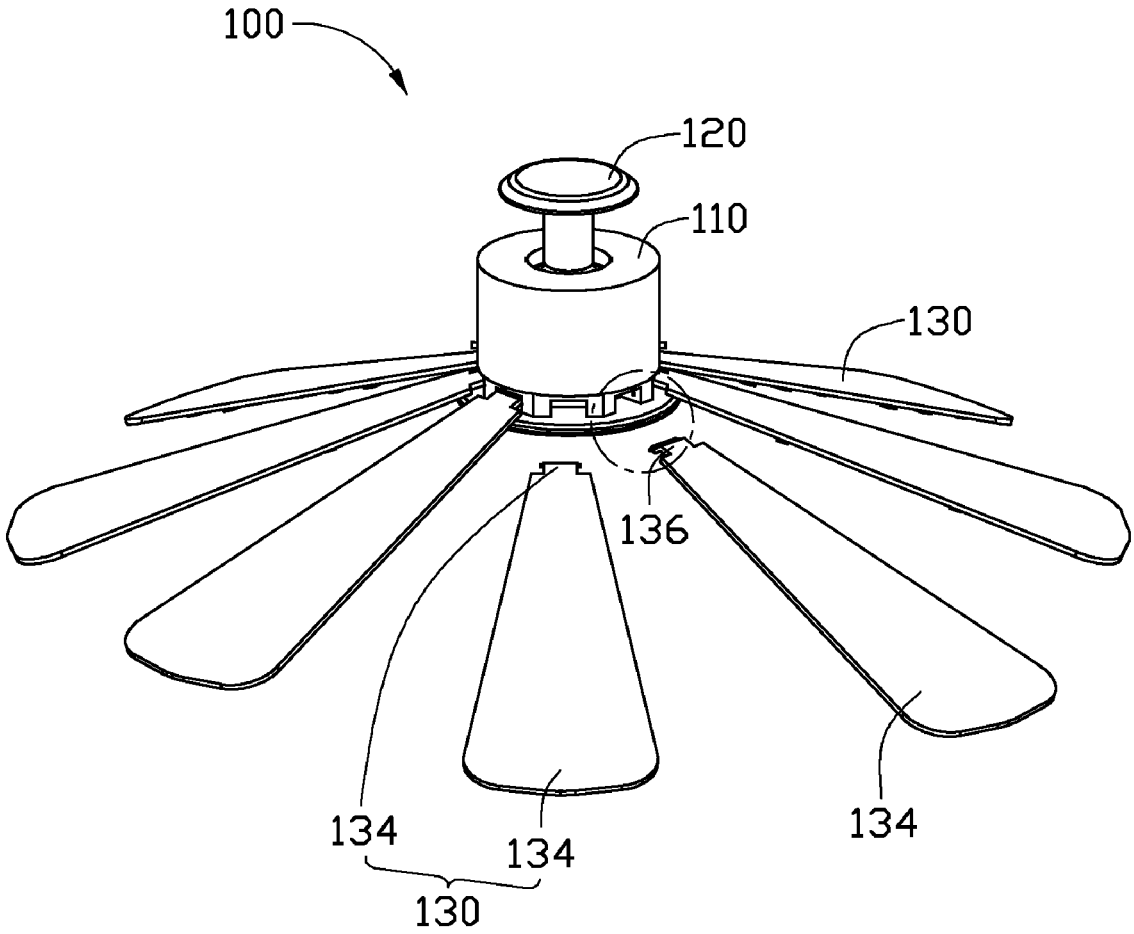
FIG. 4 is a partially exploded view of the LED lamp of FIG. 1.
Figure 5:
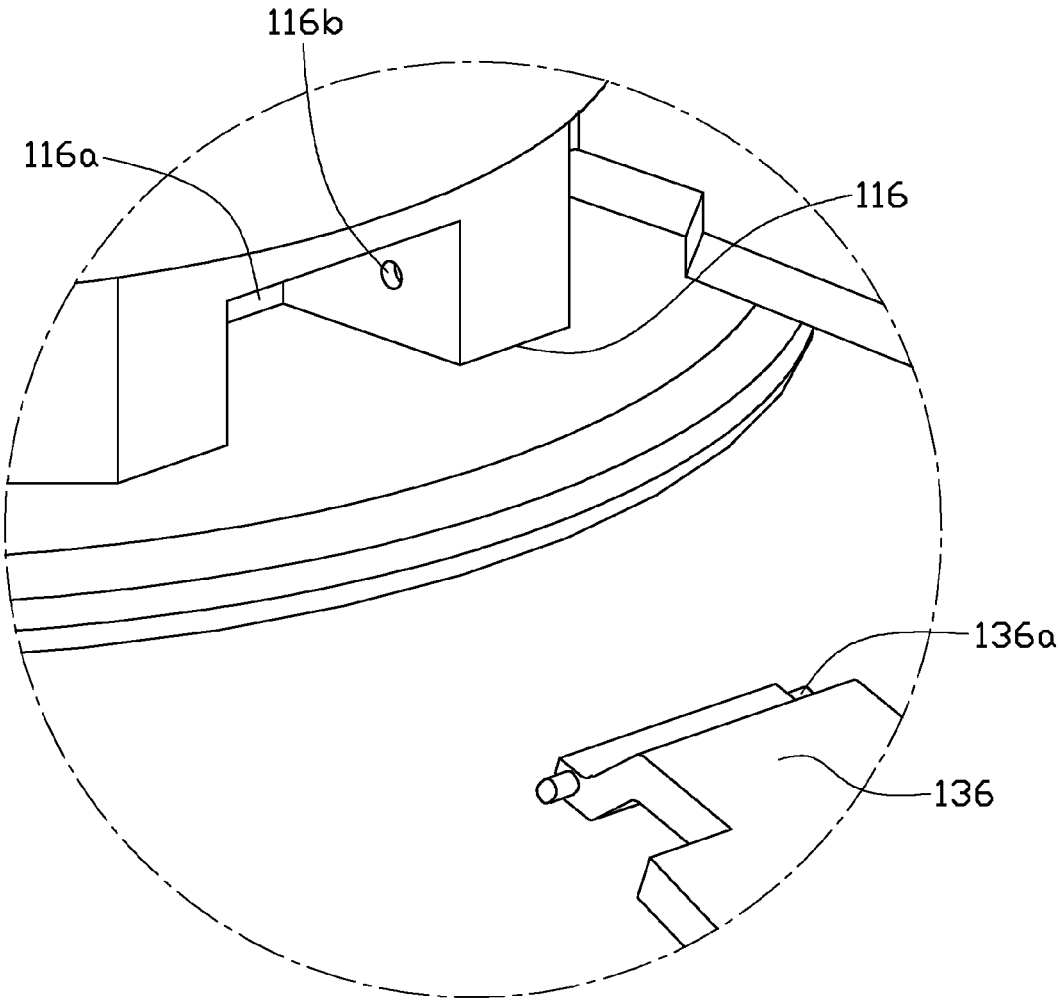
FIG. 5 is a partially exploded view of the LED lamp of FIG. 4.

Referring to FIG. 4 and FIG. 5 in conjunction with FIG. 3, the lamp body 110 includes a chamber 111, an inner wall surface 112 surrounding the chamber 111, an outer wall surface 114, and a bottom surface 116 interconnecting the inner wall surface 112 and the outer wall surface 114. A pair of grooves 112*a* is defined in the inner wall surface 112 of the lamp body 110 and symmetrical to each other around the axis of the lamp body 110. A number of depressions 112*b* are evenly defined in the bottom of each groove 112*a* opposite to the opening of the groove 112*a* for receiving the opposite ends of the flexible positioning member 150. A number of cutouts 116*a* are evenly defined in the lamp body where the outer wall surface 114 and the bottom surface 116 intersect. Each cutout 116*a* is provided for receiving the base portion of a light panel 130. On two opposite inner surfaces of each cutout 116*a*, a pair of shaft holes 116*b* is defined. The shaft holes 116*b* are provided for pivotably holding the light panel 130. The panel 130 is capable of rotating around the holes 116*b* following movement of the adjustable panel 124, to change the angle of the panel 130 relative to the center axis of the lamp body 110. In alternative embodiments, the cutout 116*a* may be defined elsewhere in the lamp body 110, such as on the bottom surface 116 or on the outer wall surface, on condition that the panel 130 is capable of rotating around the holes 116*b* defined in the cutout 116*a* following the movement of the adjustable panel 124 to change the angle.

Referring to FIG. 2 and FIG. 3, the adjusting rod 120 is slidably received in the chamber 111 of the lamp body 110. The adjusting rod 120 defines an opening 122*a* to receive the flexible positioning member 150, which in turn fixes the adjusting rod 120 in the chamber 111 of the lamp 110. A cap 126 is formed on an end of the adjusting rod 120 opposite to the adjustable panel 124, facilitating users' operation.

Referring to FIG. 4 and FIG. 5, each of the light panels 130 is designed as a paddle-shaped plate. Each panel 130 includes a support portion 134 and a base portion 136. The support portion 134 is used for supporting the LED chips 132. The base portion 136 is formed on an end of the support portion 134 for pivotally connecting the light panel 130 to the lamp body 110. The base portion 136 includes a pair of shafts 136*a* symmetrically extending outwards from opposite sides of the base portion 136. The shafts 136*a* are correspondingly received into the shaft holes 116*b* of the lamp body 110. The support portions 134 resist on the annular periphery of the adjustable panel 124.

Referring to FIG. 3, the rheostat 140 includes at least one resistive element 142 and a pair of wiper contacts 144. The resistive element 142 is received in one of the grooves 112*a*, and overlaps the bottom and the depressions 112*b* of the corresponding groove 112*a*. The wiper contacts 144 are electrically connected to each other, and respectively mounted on the opposite ends of the sliding bar 122 of the adjusting rod 120. The element 142 is electrically coupled to the power supply circuit of the LED chips 132 through the lower end, and one of the wiper contacts 144 is electrically connected to the element 142 and can be slid along a surface of the element 142. The proportion of the element 142 coupled into the power supply circuit of the LED chips 132 can be adjusted by sliding the wiper contacts 144, thereby the resistance of the element 142 coupled into the power supply circuit is changed to control the current flow in the LED chips 132 to adjust the luminance of the LED lamp 100. The wiper contacts 144 of the rheostat 140 are mounted on the opposite ends of the flexible positioning member 150 and partially received in the opening 122*a*, thereby tightly pushing against the element 142 of the rheostat 140.

The flexible positioning member 150 is configured for maintaining the position of the adjusting rod 120 relative to the lamp body 110. The flexible positioning member 150 is a spring that is sleeved in the opening 122*a*. The spring 150 is resiliently compressed when the wiper contacts 144 of the rheostat 140 pushes against the depressions 112*b*, thereby enabling the wiper contacts 144 to tightly contact the element 142 and firmly fasting the adjusting rod 120 in the chamber 111 of the lamp body 110.

Figure 6:
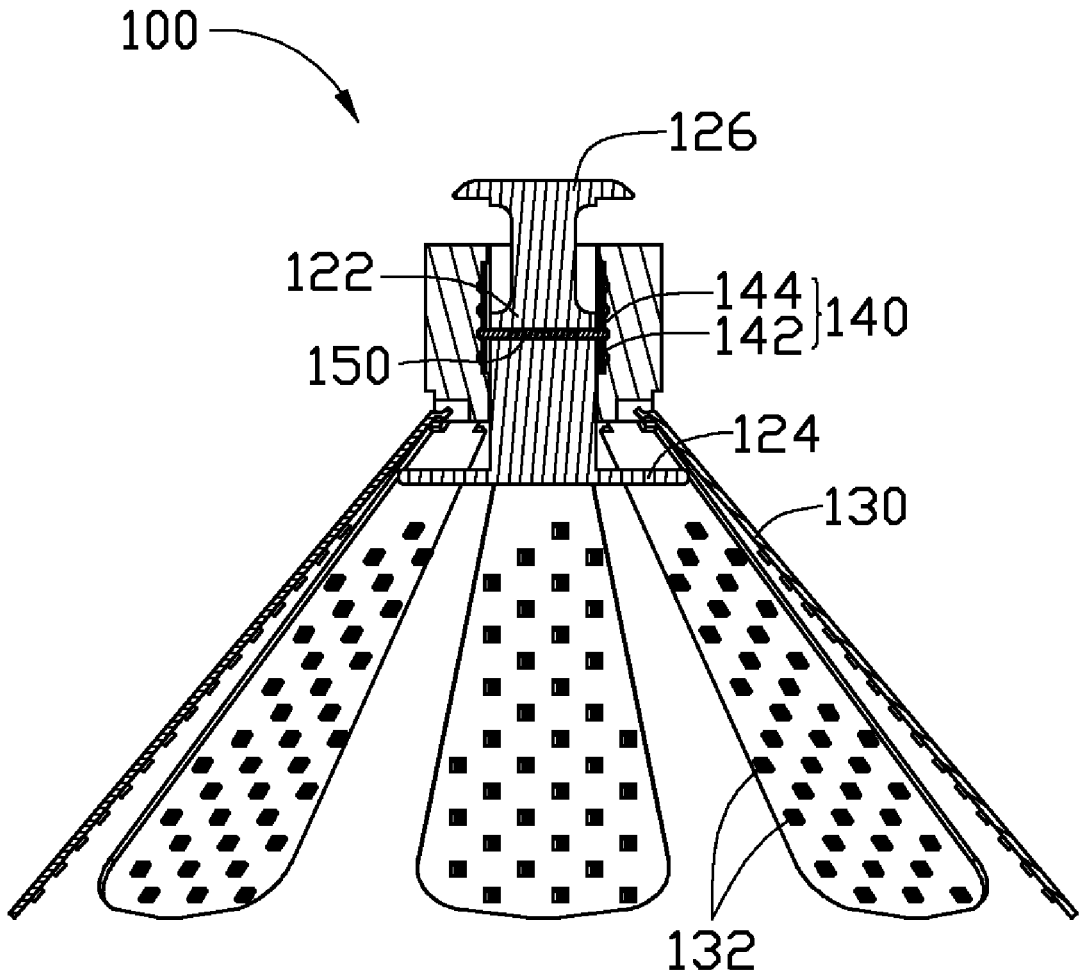
FIG. 6 is cross section view of the LED lamp of FIG. 4 in an operating state.

Referring to FIG. 6, in use, the cap 126 of the adjusting rod 120 is pressed down or lifted up by a user along the axial direction of the adjusting rod 120. Movement of the adjusting rod 120 up or down forces the spring 150 to compress, correspondingly, the wiper contacts 144 are disengaged from the depressions 112*b*. The adjusting rod 120 moves to a desired position in the chamber 111 of the lamp body 110 under the direction of the user and the wiper contacts 144 are received into a target depression 112*b*.

The spring 150 presses the wiper contacts 144 tightly against the target depression 112*b*. As such, the relative position of the adjusting rod 120 and the lamp body 110 is changed; as a result, the fulcrums on the light panels 130 are changed accordingly. With the change of the fulcrums of the light panels 130, the relative angle between the light panel 130 and the center axis of the lamp body 110 is changed, and the illumination range of the LED light lamp 100 is adjusted accordingly. At the same time, the proportion of the resistive member 142 of the rheostat 140 coupled to the power supply circuit has been changed correspondingly, thereby the luminance of the LED chips 132 of the light panel 130 is changed accordingly.

In present disclosure, the LED lamp 100 is capable of changing illumination range and luminance thereby facilitating use's directions.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An LED light lamp comprising:

a lamp body defining a chamber therein;

an adjusting rod comprising a sliding bar, and an adjustable panel extending outwards from and surrounding an end of the sliding bar; the sliding bar slidably received in the chamber of the lamp body; the adjustable panel comprising an annular periphery;

a plurality of light panels, each comprising a plurality of LED chips distributed thereon and being pivotally mounted on the lamp body and leaning against the annular periphery of the adjustable panel; and at least one rheostat electrically coupled into a power supply circuit of the LED chips, wherein the resistance of the rheostat is adjusted to adjust the current flowing through the LED chips by the sliding bar when the sliding bar slides in the lamp body.

2. The LED lamp of claim 1, wherein an angle of each light panel relative to the center axis of the lamp body is capable of being changed when the adjustable panel moves following the sliding bar.

3. The LED lamp of claim 2, further comprising at least one flexible positioning member passing through the sliding bar and resiliently resist against an inner surface of the lamp body for maintaining the relative position of the sliding bar and the lamp body.

4. The LED lamp of claim 3, wherein the bottom surface defines a number of cutouts therein for pivotally receiving base portions of the light panels.

5. The LED lamp of claim 4, wherein each panel comprises a support portion and a base portion; the LED chips are mounted on the support portion; and the base portion is formed on an end of the support portion and pivotally connected in one of the cutouts of the lamp body.

6. The LED lamp of claim 4, wherein the lamp body defines a pair of shaft holes on two opposite inner surfaces of each cutout; the base portion of each light panel comprises a pair of shafts symmetrically extending outwards from two opposite sides of the hinge portion; the shafts are correspondingly received into the shaft hole of the lamp body.

7. The LED lamp of claim 3, wherein the lamp body comprises, an inner wall surface surrounding the chamber, an outer wall surface and a bottom surface interconnecting the inner wall surface and the outer wall surface; the inner wall surface defines a pair of grooves therein; the grooves are symmetrically positioned on the inner wall surface of the lamp body around an axis of the lamp body; each of the grooves defines a plurality of depressions therein; the depressions are evenly defined on the bottom of the groove; the opposite ends of the flexible positioning member are received into a pair of the depressions.

8. The LED lamp of claim 7, wherein the adjusting rod defines an opening therein; the flexible positioning member passes through the opening and the two opposite ends are exposed from the opening.

9. The LED lamp of claim 8, wherein the at least one rheostat comprises at least one resistive element and a pair of wiper contacts; the resistive element is received in one of the grooves of the inner surface of the lamp body, and overlaps the bottom and the depressions of the groove; the wiper contacts are electrically connected to each other, and respectively mounted on the opposite ends of the flexible positioning member thereby tightly contacting to the resistive element of the rheostat.

10. The LED lamp of claim 1, wherein the at least one rheostat comprises at least one resistive element and a pair of wiper contacts; the resistive element is received in one of the grooves of the inner surface of the lamp body, and overlaps the bottom and the depressions of the groove; the wiper contacts are electrically connected to each other, and correspondingly mounted on the opposite ends of the sliding bar of the adjusting rod for electrically connecting to the resistive element.

* * * * *